United States Patent [19]

Shiau

[11] Patent Number: 5,052,688

[45] Date of Patent: Oct. 1, 1991

[54] AUTOMATIC GOLF PRACTICE COURSE

[76] Inventor: R. Jang Shiau, No. 10, Lane 48, Sec. 2, Chungshan N. Rd., Taipei, Taiwan

[21] Appl. No.: 654,872

[22] Filed: Feb. 13, 1991

[51] Int. Cl.[5] ..... A63B 69/36

[52] U.S. Cl. ..... 273/35 B; 273/201; 273/176 K; 273/182 A

[58] Field of Search ..... 273/201, 35 B, 176 F, 273/176 FA, 176 FB, 176 J, 176 K, 182 R, 182 A

[56] References Cited

U.S. PATENT DOCUMENTS 3,863,922 2/1975 Peeples ..... 273/35 B
4,934,697 6/1990 Ruey ..... 273/201 X

*Primary Examiner*—George J. Marlo
*Attorney, Agent, or Firm*—Zarley, McKee, Thomte, Voorhees & Sease

[57] ABSTRACT

An automatic golf practice course having a number of fairways, including a target area, a tee off area and a golf ball collecting/feeding assembly. The target area has a target to provide a reference for teeing and an inclined plate covered with artificial grass layers to form fairways. The inclined plate extends over an entire area of the fairways and is supported by distantly disposed bases with top surfaces having a same slope as the inclined plate. The golf balls falling from the inclined target area after being teed off are collected and fed by the collecting/feeding assembly to appear on a tee.

10 Claims, 8 Drawing Sheets

AUTOMATIC GOLF PRACTICE COURSE

BACKGROUND OF THE INVENTION

The present invention relates to an automatic golf practice course, and more particularly, to an simplified automatic golf practice course.

Applicant's U.S. Pat. No. 4,934,697 discloses an automatic golf practice course to resolve the problems encountered in the collection of golf balls. However, such an apparatus is complicated, with many pivotal flat plates, posts and other required means, and thus resultingly expensive.

The present invention provides an improved automatic golf practice course which has a structure more simple than any other conventional automatic golf practice course.

SUMMARY OF THE INVENTION

It is an object of the present invention to provide an automatic practice course for automatically collecting golf balls without the employment of workers.

Another object of the present invention is to provide an automatic golf practice course which continuously supplies golf balls for practicing golfers.

It is still another object of the present invention to provide an inexpensive and simple automatic golf practice course.

It is yet another object of the present invention to provide an automatic golf practice course with a gathering means for gathering golf balls resting on an artificial grass layer.

It is still another object of the present invention to provide an automatic golf practice course with a cleaning assembly for cleaning golf balls.

These and additional objects, if not set forth specifically herein, will be readily apparent to those skilled in the art from the detailed description provided hereinbelow, with appropriate reference to the accompanying drawings.

DETAILED DESCRIPTION OF THE PREFERRED EMBODIMENT

Figure 1:
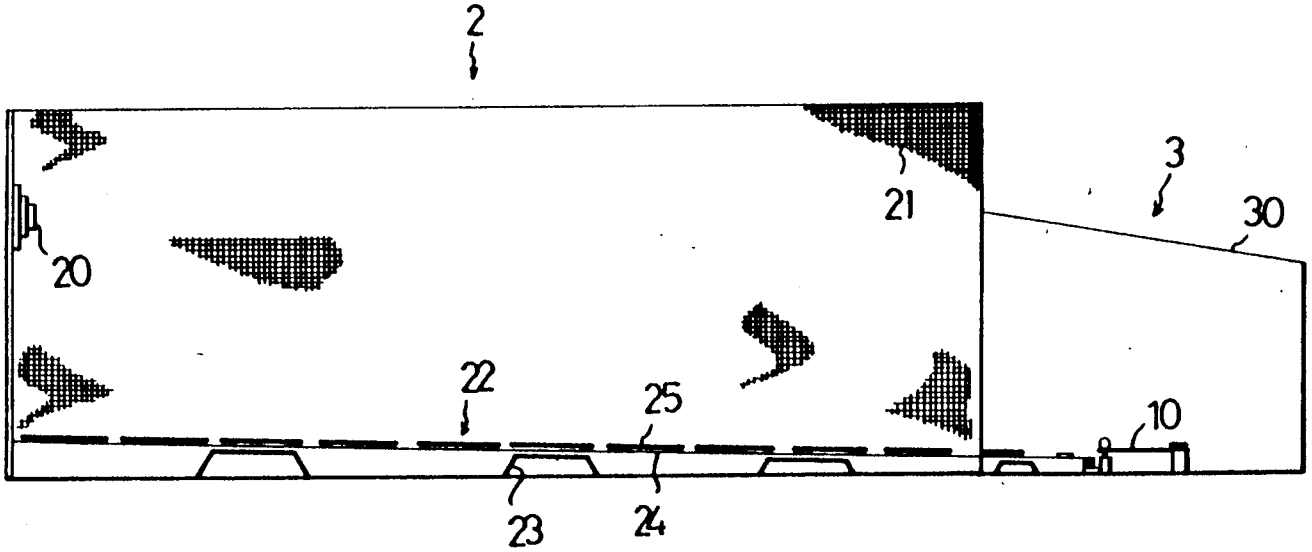
FIG. 1 is a schematic side view of an automatic golf practice course in accordance with the present invention.

Referring to FIG. 1, an automatic golf practice course according to the present invention includes a tee off area 3 and a target area 2. The target area 2 has an inclined plate 24 defining a plurality of fairways 22. Additionally, the target area 2 may be covered with a layer of artificial grass 25 to define the fairways 22. The target area 2 is bounded, for example, by a net 21, to define a closed area, so as to prevent the golf balls from escaping out of the target area 2.

The inclined plate 24 extends over an entire area of the target area 2 and is supported by distantly disposed bases 23 each with a top surface having a same slope as the inclined plate 24. A target 20 is provided on a boundary wall of the target area 2 facing the tee off area 3 to provide a reference for teeing. The tee off area 3 is substantially a teeing plate 10 for golfers to stand on and is shielded, by a shelter 30, from rain or sun, as shown in FIG. 1.

Figure 3:
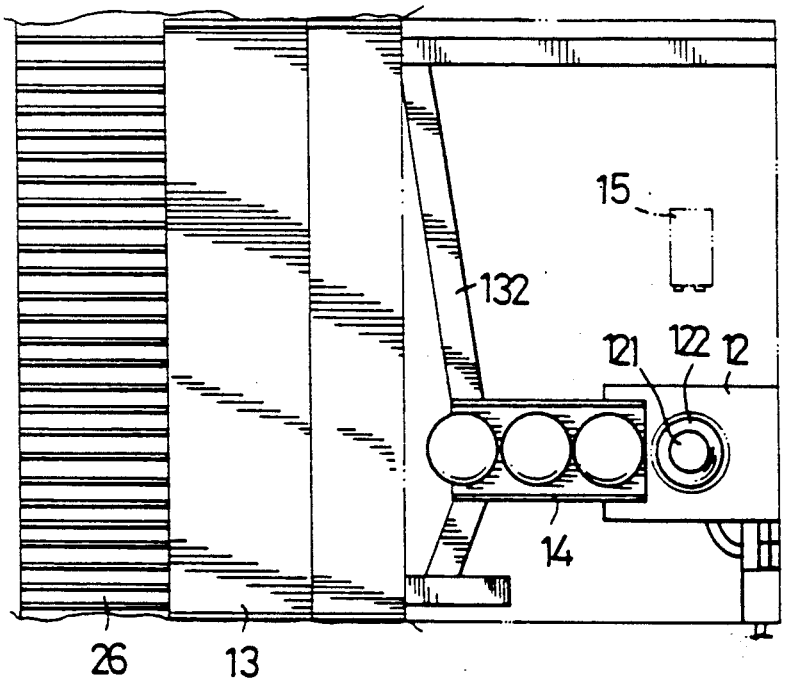
FIG. 3 is a schematic top view in which the teeing plate is removed to show the feeding of golf balls.

Referring to FIG. 3, the target area 2 further includes a drainage plate 26 provided adjacent to the tee off area 3 for draining water, rain or the like, which is conventional such that no further illustration is needed.

Figure 2:
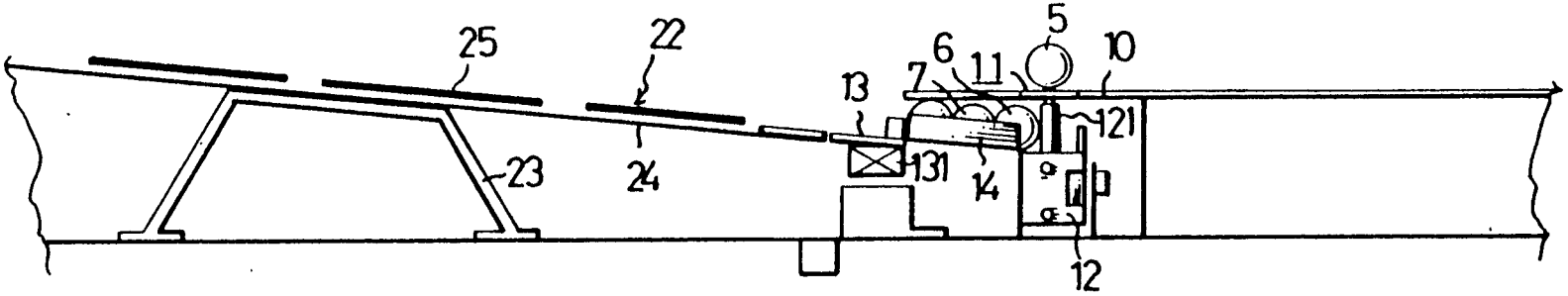
FIG. 2 is a cutaway side view of the practice course showing the feeding of golf balls.
Figure 4:
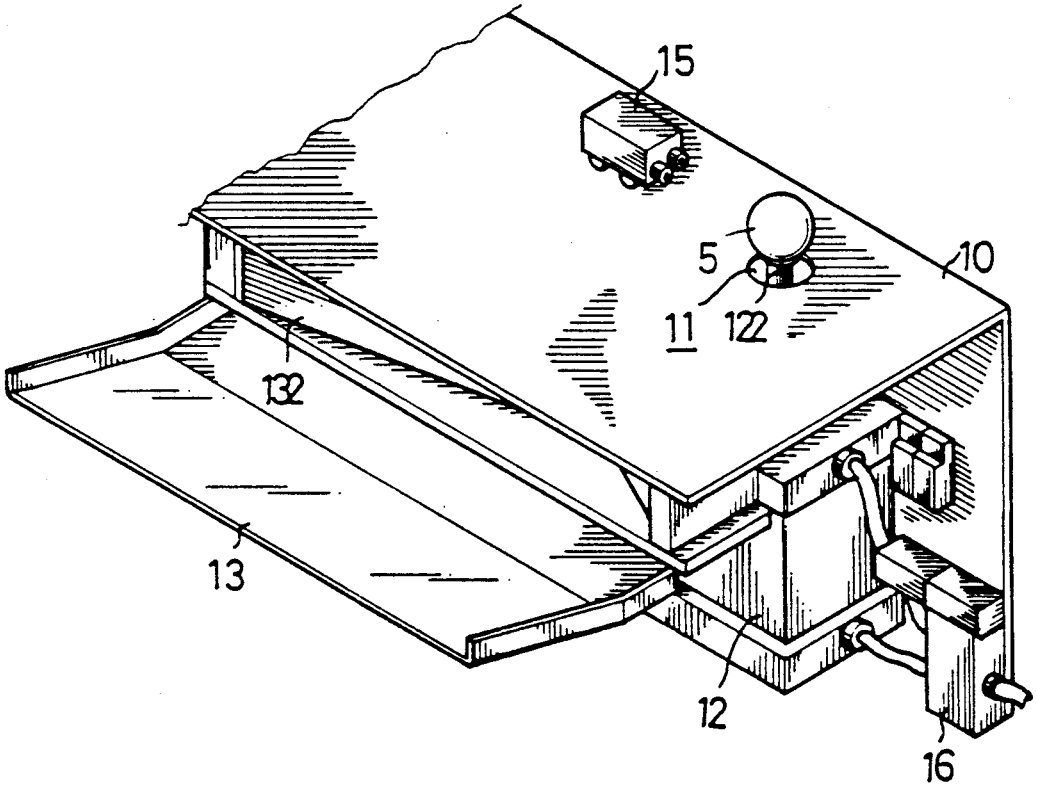
FIG. 4 is a perspective view showing a vibration plate and an electric eye provided for automatically supplying golf balls.

Referring to FIGS. 2 through 4, the present automatic golf practicing course further includes a plurality of pneumatic cylinders 12 each disposed under a plurality of equally spaced holes 11 formed on the teeing plate 10. Each pneumatic cylinder 12 has a piston rod 121 with a supporting disc 122 on a distal end thereof for supporting a golf ball thereon. The supporting disc 122 acts as a tee when the piston rod 121 is in an extended position. A feeding path 14 is provided uphill from the pneumatic cylinder 12, thereby guiding golf balls thereto. A vibrating plate 13 is provided downhill from the fairways 22. The vibrating plate 13 extends over an entire width of the fairways 22 and is driven by a motor 131 for urging the golf balls from the target area 2 to enter the feeding path 14. At least one leading wall 132 is provided downhill from the vibrating plate 13 for guiding golf balls to enter a corresponding feeding path 14 to be subsequently positioned on a corresponding supporting disc 122.

Referring to FIGS. 3 and 4, an electric eye 15 is provided adjacent to each respective tee. When a signal, indicating the golf ball has been teed off, is received, the pneumatic cylinder 12 is activated to lift another ball to rest on the tee, and subsequently repeats such procedure. Referring to FIG. 2, a golf ball 5 has been lifted to appear on the teeing plate 10, while the other balls are retained by the piston rod 121. When ball 5 is hit, the piston rod 121 moves downward through the hole 11 to a lowest retracted position. Ball 6 is urged by the supporting disc 122 to move backward (i.e., the leftward direction in FIG. 2), so that the movement of the piston rod 121 and the supporting disc 122 will not be obstructed. When the piston is in an completely retracted position, ball 6 rolls into the supporting disc 122. Then, the pneumatic cylinder 12 moves upward for subsequent teeing, with the following ball 7 retained by the piston rod 121. The pneumatic cylinder 12 is controlled by a control means 16, which is conventional and thus needs no further explanation.

Figure 5:
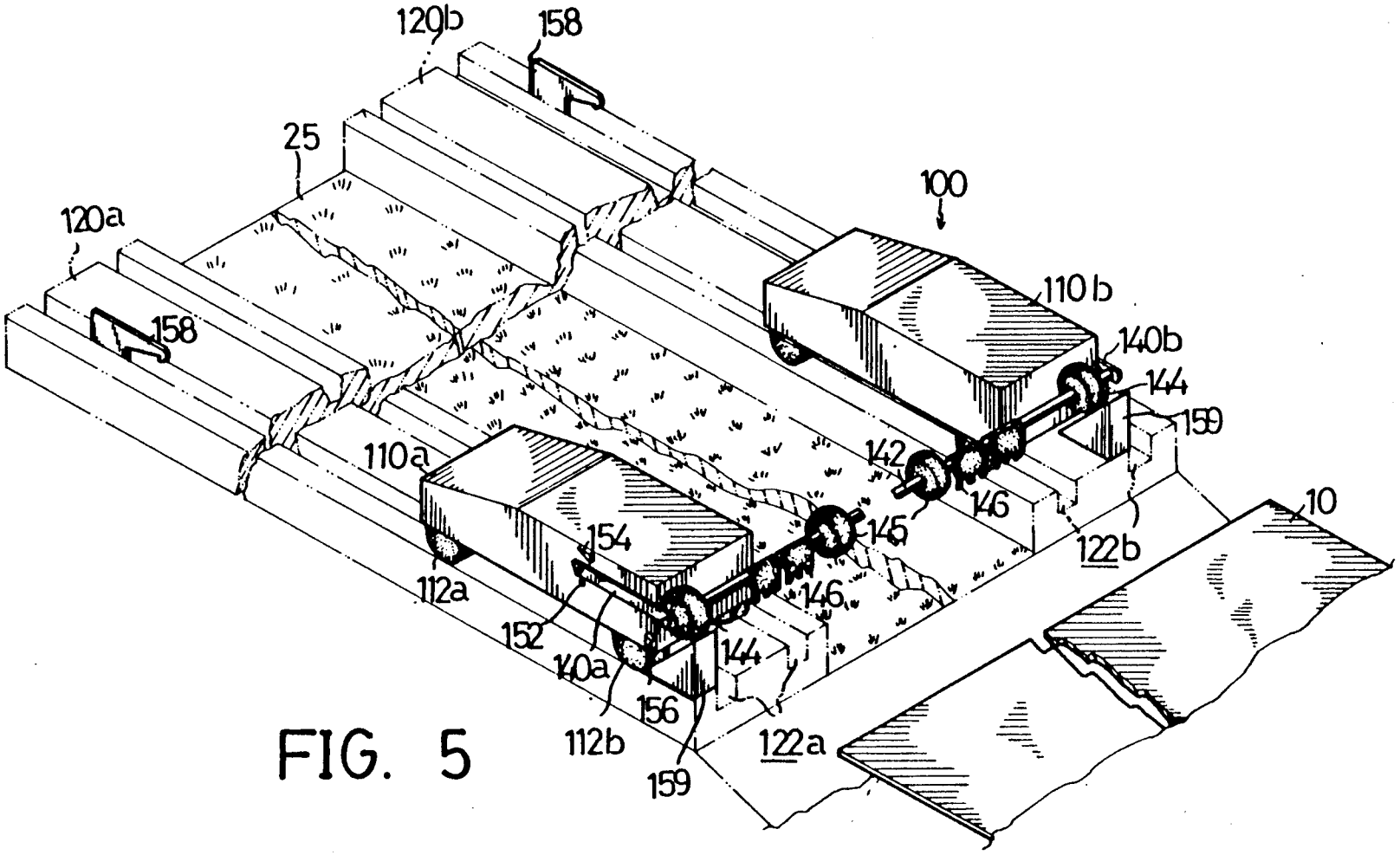
FIG. 5 is a schematic perspective view showing a ball-gathering assembly.
Figure 6:
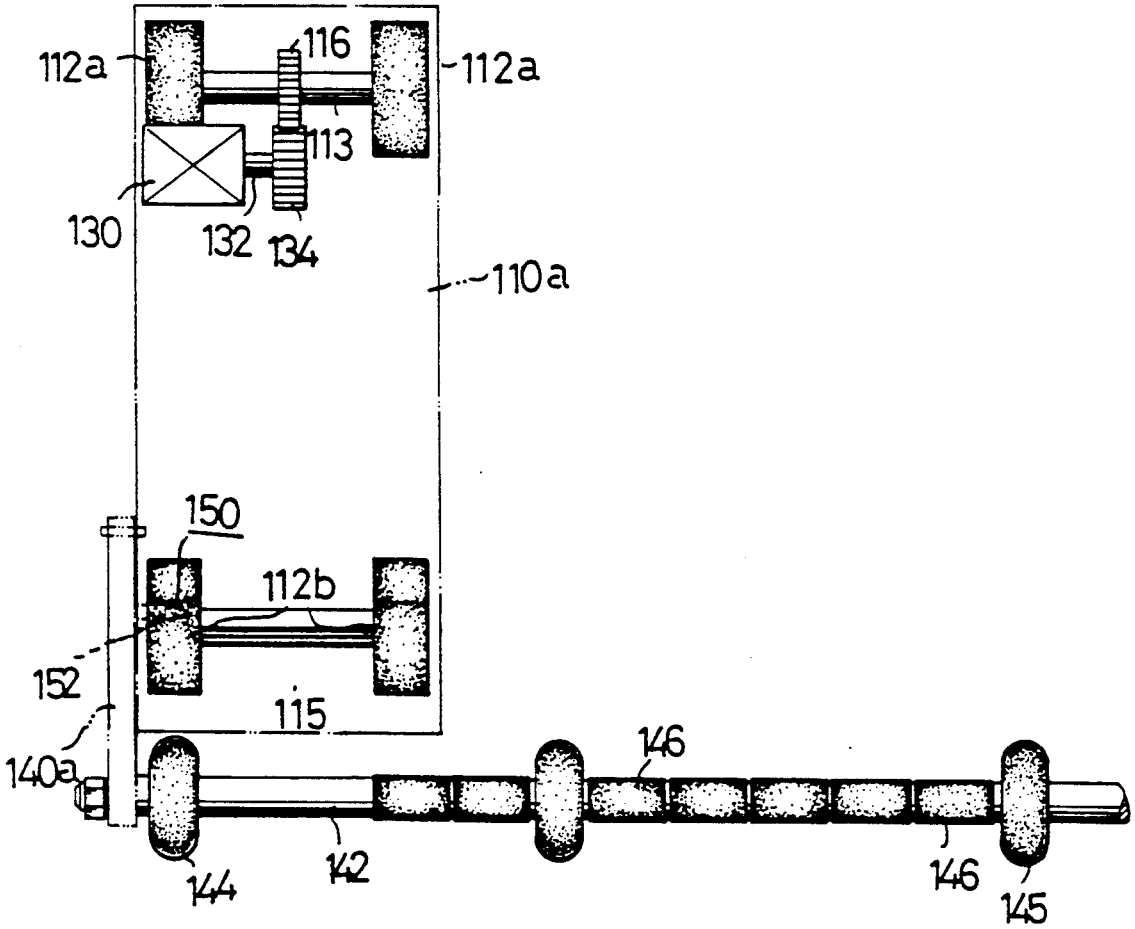
FIG. 6 is a schematic top plan view showing half of the ball-gathering assembly.

Referring to FIGS. 5 and 6, the automatic golf practicing course further has a ball-gathering assembly 100, which includes two carriers **110*a*, 110*b* each respectively guided by a track means 120*a*, 120*b* disposed adjacent to both sides of the artificial grass layer 25. Each carrier 110*a*, 110*b* is substantially carlike and has two front wheels 112*a* connected by a front wheel shaft 113 and two rear wheels 112*b* connected by a rear wheel shaft 115. The front wheel shaft 113 is driven by a driving means, such as a motor 130. In this embodiment, a gear 116 is provided on the front wheel shaft 113, and the power from the motor 130 is transmitted to the front wheel shaft 113 via a gear 134 on an output shaft 136 of the motor 130 which meshes with gear 116. Each track means 120***a*, 120*b* has two slots 122*a*, 122*b* for receiving and guiding the wheels 112*a*, 112*b* of the carriers 110*a*, 110*b*.

Figure 8:
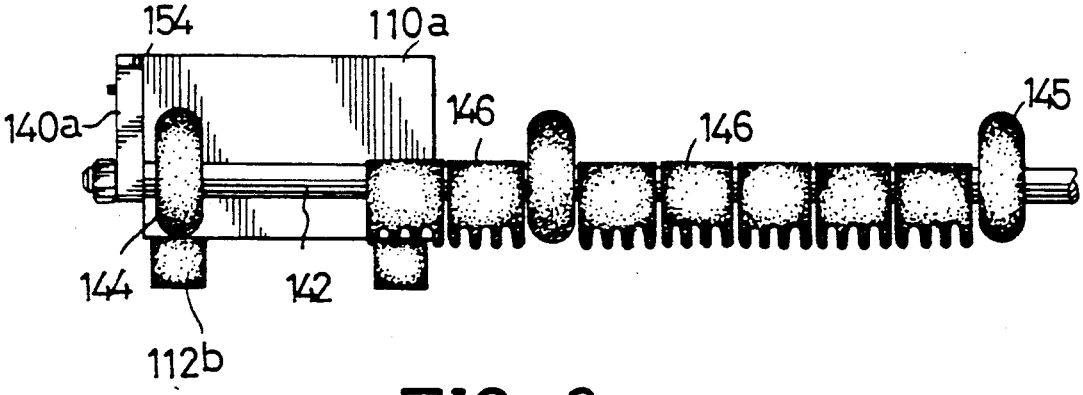
FIG. 8 is a front view of the ball-gathering assembly.

Carrier 110*a* has a bar 140*a* pivotally mounted on an outward side thereof and extending toward the tee off area 3. Carrier 110*b* also has a bar 140*b* pivotally mounted on an outward side thereof and extending toward the tee off area 3. The two bars 140*a*, 140*b* are coupled by a cross-bar 142 by means of conventional means. A guiding wheel 144 is provided adjacent to both ends of the cross-bar 142, whose purpose will be described in detail later. As shown in FIGS. 5 and 8, a plurality of gathering units 146 are provided on a middle portion of the cross-bar 142 which is above the artificial grass layer 25. Since the cross-bar 142 has a substantial length, a plurality of support wheels 145 (only two of them are shown in FIG. 5) are freely and rotatably mounted on the cross-bar 142 to support the cross-bar 142, so as to prevent undesired deformation due to gravity. Nevertheless, the support wheels 145 are restrained from lateral movement. In addition, each support wheel 145 is covered by a plastic housing which is so configured that the golf balls in the support wheel's path will be guided to move away from the support wheel and thus not obstruct the movement of the support wheel 145.

Figure 9:
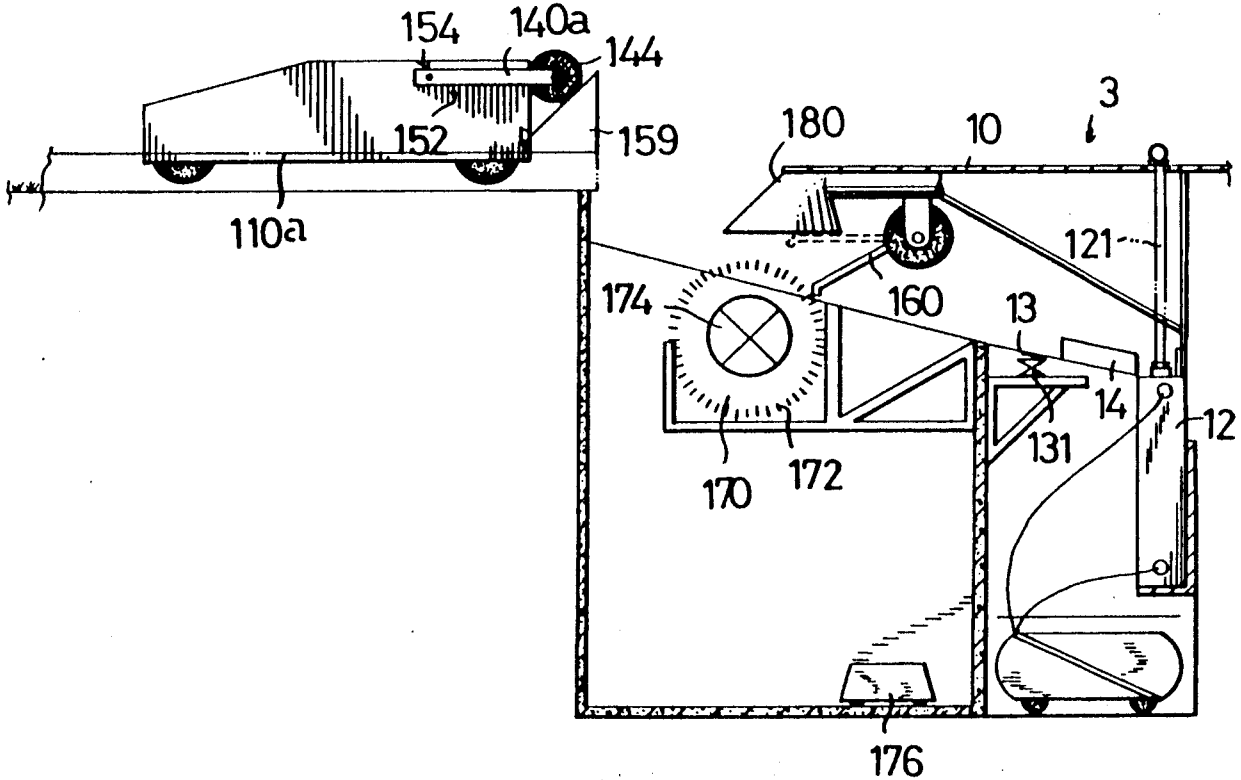
FIG. 9 is a schematic view showing a cleaning assembly.

Referring to FIGS. 5, 6 and 9, a receptacle 150 is formed on the outer side of carrier 110*a* and a spring-biased means 152 is received in the receptacle 150. In addition, two restraining blocks 154, 156 are provided on the outer side to support and limit the pivotal movement of bar 140*a*. Similar arrangement is provided on the outer side of carrier 110*b*, i.e., a receptacle, a spring-biased means, and two restraining blocks. An actuator 158 is provided adjacent to an upper end of the track means 120*a*, 120*b*. A guiding plate 159 which inclines upward toward the tee off area 3 is provided on a lower end of the track means 120*a*, 120*b*, whose purpose will be discussed in detail later.

Figure 7:
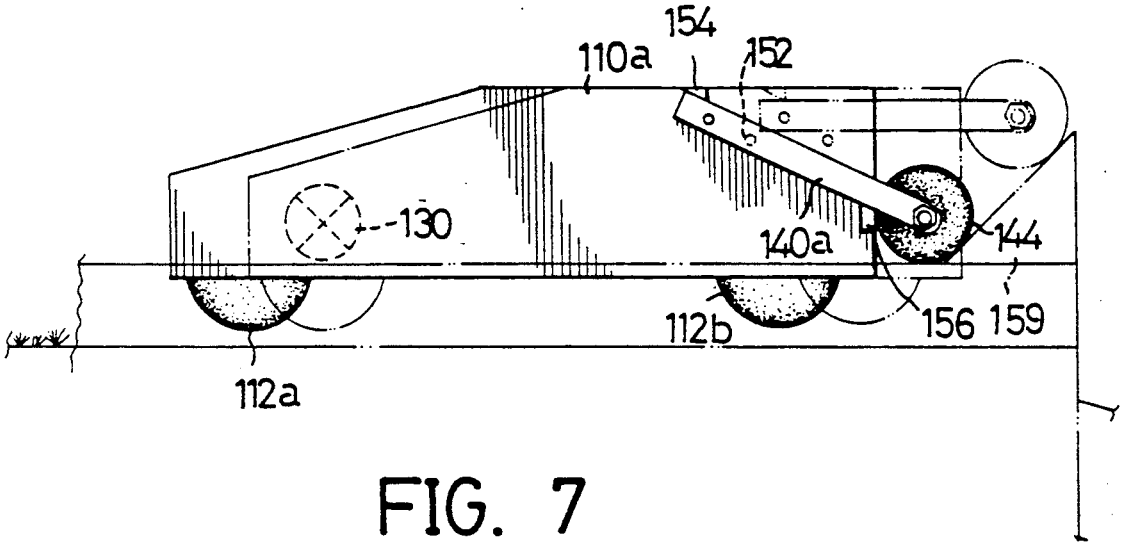
FIG. 7 is side view of the ball-gathering assembly.

Referring to FIGS. 5, 7, and 9, when the golf balls that have been hit by the golfers have fell on the artificial grass layer 25, the balls tend to rest on the artificial grass layer 25 due to friction. The carriers 110*a*, 110*b* are initially at an upper end of the track means 120*a*, 120*b*. When the golf balls on the artificial grass layer 25 reach a certain number, the motor 130 is activated (such as by remote control) to move carrier 110*a* downward, which in turn, moves carrier 110*b*. The gathering units 146 force the golf balls to move downward until being stopped by a stop plate 160. A cleaning means 170 is provided adjacent to the stop plate 160 for cleaning golf balls. The cleaning means 170 is substantially cylindrical and is covered by brushes 172 on an outer periphery thereof. The cleaning means 170 is equipped with water and detergent, such as saponaceous water, and is driven by a motor 174 to wash the golf balls. As soon as the golf balls are cleaned (e.g., for a predetermined period of time), a dryer 180 is activated to dry the golf balls. The stop plate 160 is pivoted to let the clean and dry golf balls pass therethrough to the vibrating plate 13 as described earlier. The used water is drained by a centrifugal pump 175 or a drainage plate.

In the operation of the carriers for gathering golf balls, the carriers 110*a*, 110*b* are moved to the lower end of the track means 120*a*, 120*b*. Then, the carriers 110*a*, 110*b* stop and move in a reverse direction, i.e., an upward direction. The movement of the carriers can be activated by conventionally controlling the motor 130, such as by remote control or preset timer.

When the carriers 110*a*, 110*b* reach the lower end of the track means 120*a*, 120*b*, the guiding wheels 144 move upward along a guiding plate 159, thereby lifting bars 140*a*, 140*b* upward. The spring-biased means 152 project outward to support bars 140*a*, 140*b* when bars 140*a*, 140*b* are above the receptacles 150, as shown by phantom lines in FIG. 7. Accordingly, the cross-bar 142 is lifted so that the gathering units 146 will not make contact with golf balls during a subsequent upward movement of the carriers 110*a*, 110*b*.

When carriers 110*a*, 110*b* reach the upper end of the track means 120*a*, 120*b*, the spring-biased means 152 is activated by the actuator 158 and thus completely received in the receptacle 150. Bars 140*a*, 140*b* and the cross-bar 142 thus lower and are restrained by the restraining blocks 154, 156. Accordingly, the receptacles 150 are covered and bars 140*a*, 140*b* are in a position for sweeping balls. The bars 140*a*, 140*b* may have a rectangular cross-section to assure to be retained on the spring-biased means 152. The motor 130 stops when the carriers 110*a*, 110*b* reach the upper end of the track means 120*a*, 120*b*.

While the present invention has been explained in relation to its preferred embodiment, it is to be understood that various modifications thereof will be apparent to those skilled in the art upon reading this specification. Therefore, it is to be understood that the invention disclosed herein is intended to cover all such modifications as fall within the scope of the appended claims.

I claim:

1. An automatic golf practice course comprising:

a target area having an inclined plate covered with an artificial grass layer to form a plurality of fairways and being enclosed to define said target area, said inclined plate being supported by distantly disposed bases;

a tee off area being substantially a teeing plate for golfers to stand thereon, a plurality of equally spaced holes being formed on said teeing plate each having a pneumatic cylinder disposed thereunder, each said pneumatic cylinder having a vertically retractable piston rod which is passable through said holes, each said piston rod having a supporting disc on a distal end thereof for supporting a golf ball thereon, said supporting disc acting as a tee when said piston rod is in an extended position, and said supporting disc receiving a golf ball from a feeding path provided uphill from said pneumatic cylinder when said piston rod is in a retracted position, a vibrating plate driven by a motor being provided between said teeing plate and said fairways for urging said golf balls from said target area entering said feeding paths, a plurality of leading walls being provided downhill from said vibrating plate for leading golf balls to be received on said supporting discs through corresponding feeding paths, each said pneumatic cylinder being controlled by an electric eye provided adjacent to each respective tee for activating said piston rod from said extended position to said retracted position after a golf ball on a tee has been teed off, and said piston rod moving from said retracted position to said extended position after another golf ball is fed onto said supporting disc.

2. An automatic golf practice course as claimed in claim 1, wherein said target area further includes a drainage plate provided adjacent to said tee off area for draining water.

3. An automatic golf practice course as claimed in claim 1, wherein a target is provided on a boundary wall of said target area facing said tee off area to provide a reference for teeing.

4. An automatic golf practice course as claimed in claim 1, further comprising a shelter to shield said tee off area from rain or sun.

5. An automatic golf practice course as claimed in claim 1, further comprising a ball-gathering assembly for sweeping golf balls resting on said artificial grass layer.

6. An automatic golf practice course as claimed in claim 5, wherein said ball-gathering assembly includes two carriers each guided by a track means disposed adjacent to both sides of said artificial grass layer, and a driving means provided on at least one said carrier for driving said carriers;

each carrier having a bar pivotally mounted on an outward side thereof and extending toward said tee off area, said two bars being coupled by a cross-bar, a plurality of gathering units being provided on said cross-bar for sweeping golf balls resting on said artificial grass layer.

7. An automatic golf practice course as claimed in claim 6, further comprising a plurality of support wheels freely and rotatably mounted on said cross-bar to support said cross-bar and to prevent undesired deformation due to gravity, each said support wheel being restrained in lateral movement and being covered by a plastic housing which is so configured that the golf ball will be guided to move away from the support wheel, thereby not obstructing the movement of said support wheel.

8. An automatic golf practice course as claimed in claim 6, wherein said carriers move upward to said upper end of said track means after said carriers reach said lower end of said track means, and said cross-bar is lifted during the upward movement of said carriers, such that said gathering units do not contact golf balls resting on said artificial grass layer.

9. An automatic golf practice course as claimed in claim 1, further comprising a stop plate uphill from said vibrating plate, and a cleaning means being provided downhill from said stop plate for cleaning golf balls.

10. An automatic golf practice course as claimed in claim 9, further comprising a dryer for drying golf balls washed by said cleaning means, and said stop plate being pivoted to let clean and dry golf balls pass therethrough to said vibrating plate.

* * * * *